FIBRIOD OR 4,103,236

United States

Deserno et al.

4,103,236

Jul. 25, 1978

[54] ELECTRONIC JAMMING SYSTEM

[75] Inventors: Peter Deserno, Munich; Hans Prost, Munich-Solln, both of Fed. Rep. of Germany

[73] Assignee: Siemens Aktiengesellschaft, Berlin & Munich, Fed. Rep. of Germany

[21] Appl. No.: 154,913

[22] Filed: Sep. 18, 1961

[30] Foreign Application Priority Data

Sep. 22, 1960 [DE] Fed. Rep. of Germany ..... 70474

[51] Int. Cl.[2] ..... H04K 3/00

[52] U.S. Cl. ..... 325/132

[58] Field of Search ..... 250/17 JA; 325/132, 325/18

[56] References Cited

U.S. PATENT DOCUMENTS

| | | | |
|---|---|---|---|
| 2,653,222 | 9/1953 | Williams et al. | 325/18 |
| 2,985,754 | 5/1961 | Grieg et al. | 325/132 |

*Primary Examiner*—Howard A. Birmiel

*Attorney, Agent, or Firm*—Hill, Gross, Simpson, Van Santen, Steadman, Chiara & Simpson

EXEMPLARY CLAIM

1. A method of jamming wireless communications having a frequency falling within a predetermined frequency band, by means of a powerful jamming transmission, comprising the steps of separating out from the predetermined frequency band, by an electrical filtering operation, a suspect transmission signal falling therein, producing an interference signal band having a band width sufficient to include all filtered frequencies, separating out, by an electrical filtering operation, a signal having a frequency corresponding to the frequency of the previously filtered suspect signal, from said interference signal band, and utilizing said last filtered signal at the interference frequency in the wireless transmission of a jamming signal, the frequency of which corresponds to the frequency of the suspect transmission signal so detected.

16 Claims, 3 Drawing Figures

5 SUPER GROUPS
5 BASIC GROUPS
4 PRE-GROUPS - FILTERS 12 kc IN THE BAND OF 60-108 kc
3.IF
0.8-2 Mc
A
F4
4.IF
312-552 kc
M4
F5
5.IF
60-108 kc
M5
Se
F6
12-24 kc
SB
SC
5.IF
4.IF
312-552 kc
C5
3.IF
0.8-2 Mc
C4
B
C3
NG NOISE GENERATOR
420-468-516
564-612 kc
SO5
O5
OSCILLATOR
1352-1592-1832
2072-2312 kc
SO4
O4
OSCILLATOR

ELECTRONIC JAMMING SYSTEM

This invention relates to an electronic jamming system and is particularly concerned with a method of and apparatus for jamming wireless communication with the aid of a powerful jamming transmitter, for the purpose of impairing message transmission by an enemy over as large an operation range as possible.

The jamming of wireless or radio communications poses particular difficulties when a channel is switched in only briefly, for radiating short messages with a duration of about one-tenth second, which is being done for the purpose of rendering difficult the detection of the involved transmitter and therewith the switching of a jamming transmitter. Known jamming methods, which are intended for more prolonged message transmission, fail in such cases. This situation produces a problem and a need for a new jamming method adapted to effectively jam not only prolonged radio communications but also radiation operating in spurts to transmit brief messages.

According to the invention, the jamming with the aid of a powerful jamming transmitter is made possible by searching with a detection receiver (radio direction finder), in alternate detection and jamming intervals, the wave range which is to be subjected to jamming, so as to detect transmitting stations, automatically respectively seizing and storing upon detection of a suspect transmitter, the frequency radiated therefrom, thereupon interrupting the detection operation and producing a jamming frequency spectrum for a jamming channel which embraces the stored frequency, thereafter automatically switching in the jamming transmitter to effect in the next following jamming interval amplified transmission of the jamming frequency spectrum, and automatically disconnecting the jamming transmitter at the end of the jamming interval and reconnecting the radio detection receiver for renewed detection operation.

It is with this system possible to effect automatic switching in of the jamming transmission with very short time delay amounting, for example, to one-hundredth of a second after the start of the enemy transmission. The required short switching times can be obtained owing to the fact that the detection of the enemy radio transmission and the corresponding frequency analysis as well as the switching in of the jamming transmitter are effected fully automatically.

The detection and jamming intervals continuously follow one another in brief periodic sequence, for example, by utilizing detection and jamming time intervals amounting to a few milliseconds. The jamming operation begins, for example, after a detection interval of about 0.5 milliseconds. The jamming channels in which enemy communications had been detected by the detection operation, are thereupon radiated during a transmission time of about 8.5 milliseconds. There follows then advantageously a brief pause of about 1 millisecond, in which the detection receiver remains disconnected so as to avoid reception of reflected signals coming from some targets. The cycle with a total time of about 10 milliseconds then continues after this pause.

It is advantageous to employ a timer for controlling the time spacing and the sequence of the individual switching steps in the detection and jamming periods. It is thereby possible to change in irregular sequence the duration respectively of the jamming periods and transmission times so as to make it more difficult for the enemy to take into account in his operations, the jamming times or to undertake other counter measures.

It is in the system according to the present invention after all the enemy transmitter which necessarily effects, upon switching in thereof, positive release of the jamming, for, upon detecting during the finding period a transmitter which is to be jammed, the operation of such transmitter will automatically result in switching in of the jamming operation in the jamming channel which is allotted to the detected frequency of the respective enemy transmitter.

Particularly adapted for the jamming is an embodiment of the invention in which is effected, in the detection period, a frequency analysis of the detected received frequency, by a multitude of mutually bordering narrow frequency measuring channels which cover the wave range included in the detecting operation. A corresponding multitude of channel filters is advantageously employed for the determination of the frequency measuring channels. Corresponding transmitter channels and transmitter filters respectively, which are similar to the frequency measuring channels and frequency measuring filters, can be used at the transmitter side. However, duplication of filter expenditure at the receiver and transmitter sides can be avoided by using, for the frequency measuring and for the transmitting, common channels and channel filters which are switched over upon changing from the detection operation to the jamming operation. The frequency analysis can be placed into a lower frequency position, after one or more conversions of the received frequency, effecting thereby at the transmitter side a reconversion to the original frequency position of the received frequency. The seizing and storing of the received frequency is suitably effected by relay or switch means which are operatively actuated over the respective frequency measuring channels and channel filters, by the frequencies received during the finding or detecting period.

Radio communications involving a bandwidth of about $\pm 2.5$ kilocycles, radiated with amplitude modulation, can be in simplest manner effectively jammed by noise modulation. The jamming frequency spectrum is therefore advantageously produced by a noise generator which is switched to the transmitter over transmitter channels and transmitter filters which are allotted to the detected received frequencies.

The foregoing and further objects and features of the invention will now be described with reference to the accompanying drawings.

Figure 1:
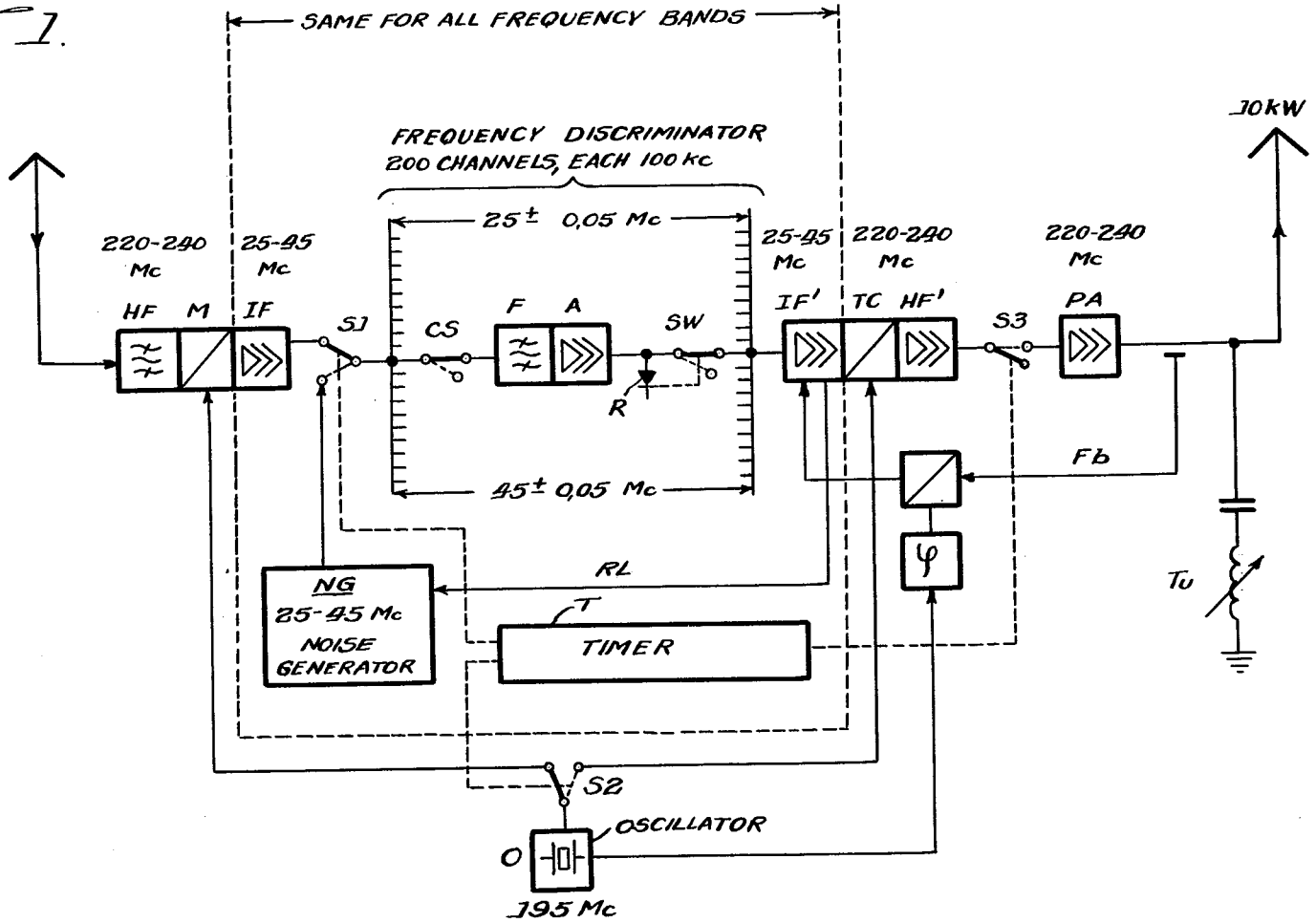
FIG. 1 shows in block diagram manner an example of an arrangement of parts for practicing the jamming method according to the invention.

Referring now to FIG. 1, the frequency range which is to be jammed is assumed to have a bandwidth of 20 megacycles and extends over a range from 220 to 240 megacycles. It is assumed, as an example, that this band or range is without gaps subdivided into 200 channels each with a bandwidth of 100 kilocycles. The detection receiver comprises a high freuency part HF with an input filter of 20 megacycles bandwidth, followed by a mixer part M in which the received high frequency band of 220 to 240 megacycles is, by means of a quartz oscillator 0 of 195 megacycles, transferred into the intermediate frequency position of 25 to 45 megacycles. The intermediate frequency band is amplified, in a linear intermediate frequency amplifier IF of 20 megacycles, only to such extent that practically no combination frequencies can be produced by nonlinearities. Next in series are disposed 200 plural circuit band filters for carrying out the frequency analysis, each filter having a band width of 100 kilocycles, such band filters being parallel connected at the respective input and output sides. Only one of these filters marked F is shown in the drawing. The received signal at the filter output is in a selective amplifier SA, disposed ahead of each filter, amplified to a constant level. The amplified signal is rectified in a rectifier R for the purpose of actuating a relay switch or electronic channel switch SW which connects the filter in the IF position at the transmitting side, with a successive wideband amplifier IF'. One or more filters in which voltages are ascertained, received during the detection period, from transmitters which are to be jammed, are in this manner switched through, thereby storing or marking the ascertained frequencies by the actuation of the respective relays or switches SW.

The transmission interval or period is initiated, for example, by an electronic switch S1, which is operated by a timer T to switch the filter channels from the detector to the noise generator NG, such noise generator delivering a uniform humming noise in the range from 25 to 45 megacycles. The filters which had been before, in the detection period, connected with the detection amplifier, now operate as transmission filters and take from the wide noise band of the generator NG only those narrow frequency bands containing the frequencies of the transmitter which had been detected by the detection receiver during the detection period. The timer T is at the same time operative to actuate, for example, an electronic switch S2 so as to switch the quartz oscillator O to the transmitter converter TC in which the intermediate frequency is restored to the high frequency position of 220 to 240 megacycles. The converted frequencies are in this position amplified by a high frequency amplifier HF' which is switched to the power amplifier PA of the transmitter, such switching being effected by means of a switch S3 which is likewise operatively controlled by the timer T. The switch S3 thus serves for switching in the transmission terminal stage at the start of the jamming and also for the interruption of the transmission (jamming) during the detection period.

The transmitter delivers, for example, a radiated jamming power of about 10kW and always shall deliver the maximum power irrespective of the number of jamming channels which are switched through. The output power of the transmitter is advantageously held constant, by an automatic amplifier regulation, since the involvement of jamming channels can fluctuate rapidly and strongly. An amplifier regulation circuit ARC is for this purpose branched off in back of the transmitter converter TC, such circuit affecting the noise generator NG and regulating the output voltage thereof so that the transmitter is responsive to addition or reduction of jamming channels always held at maximum power output.

The jamming method shall of course be operative to jam only the radio communication of the enemy, while the own radio communication which takes place in the region of the jamming transmitter shall be maintained substantially free of trouble. This is made possible according to the invention by the provision of switching means for disconnecting manually or by remote control, as needed, those jamming channels which are to be held free for own radio communication. There are for this purpose provided cutout switches such as CS, respectively in all filter channels or in the channels which are to be held free, by means of which the respective channels can be temporarily or permanently excluded from the jamming operation, as desired.

Measures are moreover advantageously taken to avoid the formation, due to non-linearities or the like, of combination frequencies which could fall within the channels to be held free for the own communications. For example, feedback means can be used for this purpose to improve the linearity of the amplifiers especially at the transmitter side including the transmitter converter and the preceding stages, so that the power with respect to the combination frequencies remains low. In the illustrated embodiment, such a linearizing feedback Fb is branched off ahead of the transmitter power amplifier stage PA, leading back to the transmitter amplifier part IF', the optimum adjustment being thereby effected by the phase shift $\phi$. A tuning circuit Tu is moreover connected parallel to the transmitter output, which makes it possible to effect further suppression of combination frequencies with respect to channels to be held free.

A frequency analysis as accurate as possible and radiation aimed as sharp as possible to the jamming bands of ascertained transmitter frequencies are to be provided so as to increase the efficiency of the system. This calls for a very fine subdivision into very narrow channels and requires increase of the number of channels and the bandwidth thereof. The expenditure for the frequency analysis and for the storing of the ascertained frequencies is thereby increased, resulting however in the advantage of increasing the jamming power radiated per frequency unit. For example, in case a jamming transmitter power of 10kw is required for the jamming of a given range with jamming channels of 100 kilocycles bandwidth, a narrowing down of the jamming channels to a bandwidth of 10 kilocycles will permit to jam the same range with a transmitter power of 1 kw.

Figure 2:
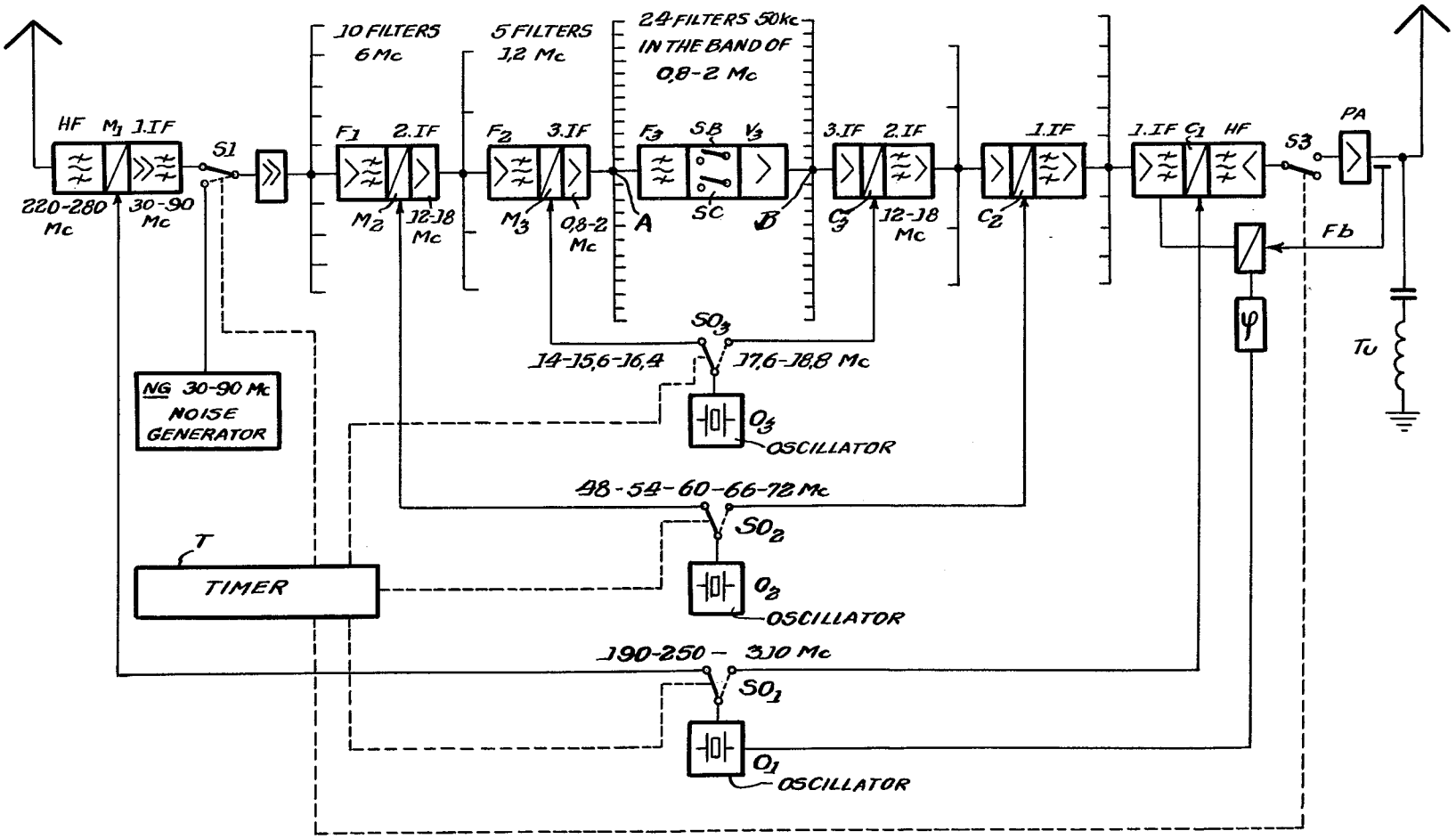
FIG. 2 is a block circuit of an embodiment employing groups of channels obtained by subdivision of the frequency range to be covered.

The frequently arising requirement to embrace a greater wave range poses the problem of providing for the application of the method and system, a few thousand narrow channels of about 10 to 20 kilocycles bandwidth. In order to hold the filter expenditure for such a greater number of channels as small as possible, the required frequency range can be advantageously subdivided into groups of identical channels, by plural frequency conversion into lower IF-positions. The principle known in the frequency carrier technique and calling for pregroups, basic groups and super groups can thereby be advantageously applied. It will then be possible, to use for the frequency analysis, standard filters and other standard components which recur in the groups within the filter system. FIG. 2 shows a block circuit diagram of an embodiment of this kind.

Referring now to FIG. 2, the high frequency part HF of the detection receiver records an extended HF-range of 220 to 280 megacycles, such range being converted in the mixer part $M_1$, by the action of a quartz oscillator $O_1$, to a first intermediate frequency 1.IF of 30 to 90 megacycles. This first intermediate frequency band or range is subdivided tenfold, by means of ten filters $F_1$, each with a bandwidth of 6 megacycles, and is, by means of a mixer part $M_2$ and by the action of a multiple quartz oscillator $O_2$, converted into a second intermediate frequency 2.IF with each filter having a bandwidth from 12 to 18 megacycles. Each 2.IF- range of 12 to 18 megacycles bandwidth is fivefold subdivided by means of five filters $F_2$ each with 1.2 megacycles bandwidth, and each is by means of a mixer part $M_3$ and the action of a multiple quartz oscillator $O_3$ converted to a 3.1F of 0.8 to 2 megacycles, each of the latter being by means of 24 filters $F_3$ of 50 kilocycles bandwidth and serially disposed amplifiers such as $V_3$, subdivided into 24 channels. The individual oscillator frequencies required for the conversions are indicated in connection with the respective oscillators. The switches for switching over the respective oscillators are indicated at $SO_1$, $SO_2$, $SO_3$.

There will thus result 10 times 5 jamming channel groups each with 24 jamming channels of 50 kilocycles bandwidth, totalling 1200 jamming channels over a wave range of 60 megacycles bandwidth. Converters $C_3$, $C_2$, $C_1$ each followed by an amplifier effect with the aid of the oscillators $O_3$, $O_2$, $O_1$ reconversion respectively from the 3.IF into the 2.IF and 1.IF and thereafter into the HF-position. The selected jamming channels are thereupon in the 60 megacycles preamplifier HF and the terminal power amplifier PA, brought to the desired power. The detection receiver and the jamming transmitter can of course be constructed in the HF parts for switching over to a plurality of different wave ranges.

Figure 3:
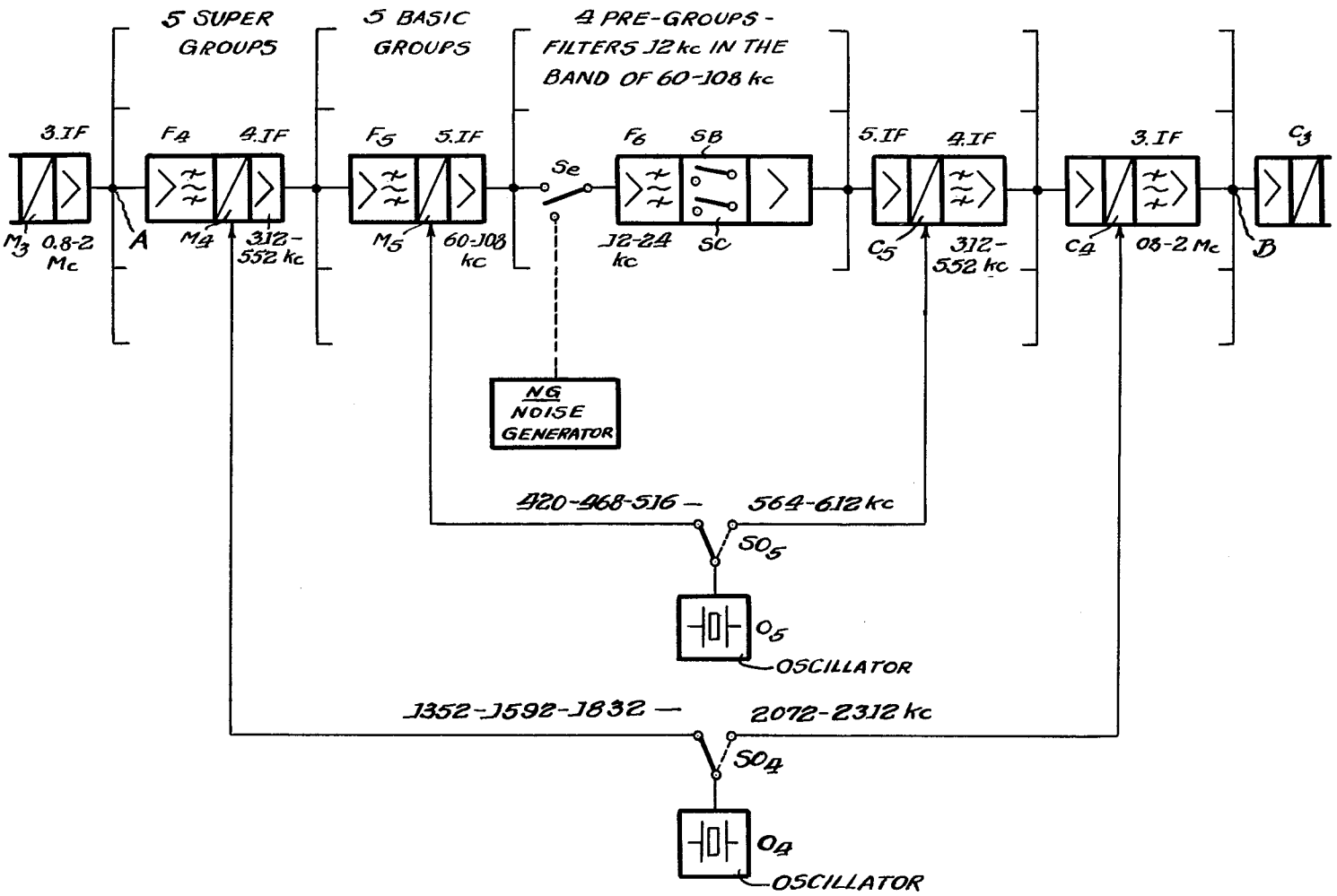
FIG. 3 shows a further embodiment of parts included in FIG. 2 between the points A and B thereof.

FIG. 3 shows a further embodiment of the parts disposed between the points A and B of FIG. 2. For obtaining extremely narrow channels, this embodiment subdivides the 3.IF range of 0.8 to 2 megacycles by five super group filters $F_4$ into five super groups of 240 kilocycles bandwidth in which is respectively effected, in a mixer part $M_4$ thereof, by a multiple quartz oscillator $O_4$, a conversion in five base groups in the 4.IF-position of 312 to 552 kilocycles. The base group filters are indicated at $F_5$, each having a bandwidth of 48 kilocycles. In each base group is effected, in a mixer part $M_5$, by a multiple quartz oscillator $O_5$, a conversion into a 5.IF-position of 60 to 108 kilocycles bandwidth, each of which contains four pregroups of 12 to 24 kilocycles bandwidth represented by pregroup filters $F_6$. The reconversion is appropriately effected in the converters $C_5$, $C_4$, etc., the switches $SO_4$, $SO_5$ being for this purpose actuated to assume alternate positions. In this embodiment, there are formed fifty principal base groups each with five super groups, each containing five base groups each with four pregroups. There are thus obtained 5000 similar jamming channels with 12 kilocycles bandwidth, permitting the use of components which are known from the carrier frequency technique.

In the examples shown in FIGS. 1 and 2, the jamming modulation is effected in the 1.IF position, with the aid of the noise generator NG, shown in FIG. 1. The jamming modulation can of course be effected in another IF-position. For example, in the embodiment shown in FIG. 3, the jamming modulation can be effected in the pregroup positions of 12 to 24 kilocycles, using for this purpose a noise generator NG of 12 to 24 kilocycles, which is switched in in the plane of the pregroups.

Changes may be made within the scope and spirit of the appended claims which define what is believed to be new and desired to have protected by Letters Patent.

We claim:

1. A method of jamming wireless communications having a frequency falling within a predetermined frequency band, by means of a powerful jamming transmission, comprising the steps of separating out from the predetermined frequency band, by an electrical filtering operation, a suspect transmission signal falling therein, producing an interference signal band having a band width sufficient to include all filtered frequencies, separating out, by an electrical filtering operation, a signal having a frequency corresponding to the frequency of the previously filtered suspect signal, from said interference signal band, and utilizing said last filtered signal at the interference frequency in the wireless transmission of a jamming signal, the frequency of which corresponds to the frequency of the suspect transmission signal so detected.

2. A method of jamming wireless communications as defined in claim 1, wherein said suspect transmission signal is converted to a signal of an intermediate frequency falling within a predetermined intermediate frequency band, filtering from said intermediate frequency band a signal corresponding to the intermediate frequency representing the suspect signal, producing said interference signal with a band width corresponding to that of said intermediate frequency band, filtering from said interference signal a signal having the frequency corresponding to the intermediate frequency of the suspect signal, and converting said filtered signal having such interference frequency to the frequency of said suspect signal to form the jamming signal to be transmitted.

3. A method of jamming wireless communications as defined in claim 1, comprising the steps of simultaneously respectively filtering from the predetermined frequency band, all suspect transmission signals, simultaneously respectively filtering from said interference signal all signals having frequencies corresponding to the previously filtered suspect signals, and simultaneously transmitting a jamming signal for each detected suspect transmission signal.

4. A method of jamming wireless communications as defined in claim 1, wherein all suspect transmission signals, falling within said predetermined frequency band, are converted to respective signals having intermediate frequencies falling within a predetermined intermediate frequency band, filtering from said intermediate frequency band all signals having intermediate frequencies representing respective suspect signals, producing said interference signal with a band width corresponding to that of said intermediate frequency band, respectively filtering from said interference signal all signals having frequencies corresponding to the intermediate frequencies of the respective suspect signals, and respectively converting said filtered signals having interference frequencies to signals having the respective frequencies of the corresponding suspect signals to form the respective jamming signals to be transmitted.

5. A method of jamming wireless communications, operating on frequencies falling within a predetermined frequency band, by means of a powerful jamming transmission, comprising the steps of alternatively detecting suspect transmissions over a predetermined wave range and radiating jamming signals upon a wave length of any suspect transmission so detected, simultaneously testing during a detection period said frequency band in a multitude of mutually bordering narrow frequency channels so as to ascertain suspect transmission therein, marking each channel upon determining a transmission therein, and passing over each so marked channel a signal having an interference frequency spectrum, forming from each of the latter a corresponding jamming signal and simultaneously transmitting all jamming signals so formed.

6. A system for jamming wireless communications within a predetermined wave band, with the aid of a powerful jamming transmitter, employing detection periods followed by jamming periods, means for controlling the duration of the respective periods, means for automatically selecting a respective frequency representative of the transmitted frequency of each suspect transmitter ascertained during the detection period, means for producing a signal comprising an interference frequency spectrum having a band width corresponding to said predetermined wave band, means cooperable with said selection means for obtaining from said interference frequency spectrum the respective frequencies thereof corresponding to each selected frequency, and means utilizing each respective interference frequency for forming and transmitting during the following jamming period a corresponding jamming signal having the frequency of the corresponding suspect transmitter.

7. In a system accordance to claim 6, wherein said selection means includes a series of mutually bordering frequency measuring channels for effecting during the detection period a frequency analysis of the ascertained received frequency, said channels covering said predetermined wave band.

8. In a system according to claim 7, wherein said frequency measuring channels comprise a corresponding number of channel filters.

9. In a system according to claim 8, wherein said system is provided, at the transmitting side, with a series of transmitter channels and transmitter filters corresponding in number to the frequency measuring channels and frequency measuring filters.

10. A system according to claim 9, wherein a series of common channels and channel filters are employed for the frequency measurement and the transmitting, respectively, and means for switching said common channels and filters from the detection operation to the jamming transmission operation and vice versa.

11. A system according to claim 10, comprising means for effecting at least one conversion of the received frequency into a lower frequency position prior to frequency analysis thereof, and effecting reconversion to the original frequency position at the transmitter side.

12. A system according to claim 11, comprising suitable switch means for designating the received frequencies, and circuit means for operatively actuating said switch means over the involved frequency measuring channels and channel filters by the received frequencies ascertained in the detection periods.

13. A system according to claim 12, comprising a noise generator for producing the jamming frequency spectrum, and means for connecting said generator in an intermediate frequency position to the transmitter over the transmitter channels and transmitter filters corresponding to the ascertained received frequencies.

14. A system according to claim 13, comprising switching means for blocking given jamming channels.

15. A system according to claim 7, comprising means for automatically regulating the amplification of the jamming transmitting means so as to maintain in the presence of fluctuating numbers of jamming channels a maximum output power.

16. A system according to claim 15, wherein the formation of harmonic waves, in channels which are to be held free for communication, is prevented by means including linear amplifier means and feedback coupling, respectively.

* * * * *